United States Patent [19]

McKinney et al.

[11] 4,061,562

[45] Dec. 6, 1977

[54] THERMAL CRACKING OF HYDRODESULFURIZED RESIDUAL PETROLEUM OILS

[75] Inventors: Joel Drexler McKinney; Raynor T. Sebulsky, both of Pittsburgh; Francis Edmund Wynne, Jr., Allison Park, all of Pa.

[73] Assignee: Gulf Research & Development Company, Pittsburgh, Pa.

[21] Appl. No.: 704,454

[22] Filed: July 12, 1976

[51] Int. Cl.[2] ..... C07C 11/04; C10G 9/32

[52] U.S. Cl. ..... 208/61; 208/57; 208/58; 208/78; 208/89; 208/127; 260/683 R

[58] Field of Search ..... 208/78, 89, 127, 57, 208/58, 61; 260/683 R

[56] References Cited

U.S. PATENT DOCUMENTS

| | | | |
|---|---|---|---|
| 2,422,501 | 6/1947 | Roetheli | 208/169 X |
| 2,731,508 | 1/1956 | Jahnig et al. | 208/53 |
| 2,768,127 | 10/1956 | Kimberlin et al. | 208/50 |
| 2,813,916 | 11/1957 | Boston | 208/53 |
| 2,903,416 | 9/1959 | Metrailer | 208/127 |
| 2,943,042 | 6/1960 | Stokes et al. | 208/127 |
| 3,039,955 | 6/1962 | Honnold | 208/132 |
| 3,617,502 | 11/1971 | Stolfa et al. | 208/89 |
| 3,898,299 | 8/1975 | Jones | 260/683 R |
| 3,907,920 | 9/1975 | Starks | 260/683 R |

*Primary Examiner*—Delbert E. Gantz
*Assistant Examiner*—G. E. Schmitkons

[57] ABSTRACT

A process for the production of ethylene by the non-catalytic riser cracking of hydrodesulfurized residual petroleum oils in the presence of entrained hot, inert solids.

22 Claims, 7 Drawing Figures

THERMAL CRACKING OF HYDRODESULFURIZED RESIDUAL PETROLEUM OILS

Figure 1:
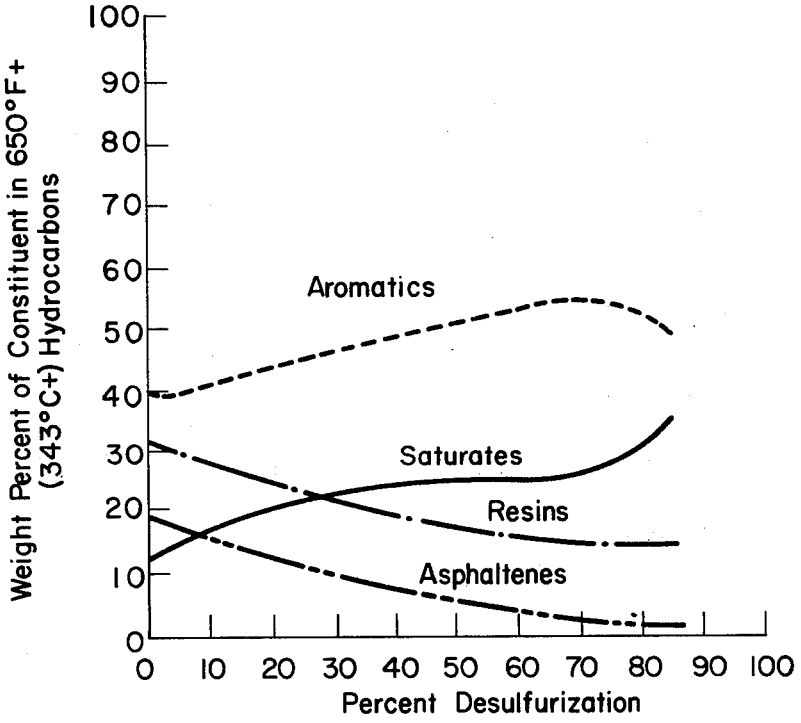

This invention relates to a process for non-catalytic thermal cracking of hydrodesulfurized residual petroleum oils in the presence of a gaseous diluent and an entrained stream of inert heat carrier solids.

The present cracking process is directed towards the recovery of gaseous olefin as the primarily desired cracked product, in preference to gasoline range liquids. At least 15 or 20 weight percent of the feed oil is converted to ethylene. While ethylene is the single most prevalent gaseous product most of the feed oil is converted to both other gaseous products and to liquid products. Other valuable hydrocarbon gaseous products include propylene and 1,3-butadiene. Other $C_4$'s and ethane are also produced. Hydrogen is recovered as a valuable non-hydrocarbon gaseous product. Liquid products are produced in the cracking process by combination of intermediate olefinic material in the reactor and can comprise 40 or 50 weight percent or more of the total product. Recovered liquid products include benzene, mixtures of benzene, toluene and xylenes (BTX), gasoline boiling range liquids and light and heavy gas oils. The economic value of the various gaseous and liquid hydrocarbon products is variable and depends upon prevailing market conditions. Coke is a solid product of the process and is produced by polymerization of unsaturated materials. Most of the coke formed is removed from the process as a deposit upon the entrained inert heat carrier solids.

The proportions of the various products obtained depend significantly upon cracking severity, which can be expressed in terms of methane yield since methane is the ultimate hydrocarbon product. At a low severity, i.e. at methane yields below about 4 or 6 weight percent based on feed oil, yields of most products will be low. At a moderate severity, i.e. at methane yields above about 4 or 6 but below about 12 or 14 weight percent, optimum yields of intermediate olefins such as propylene and 1,3-butadiene will be realized. At high severities, i.e. at methane yields above about 12 or 14 weight percent, yields of propylene and 1,3-butadiene will decline and yields of very light materials, such as methane, hydrogen, and ethylene will tend to increase.

In the thermal cracking operation, a stream of hot solids supplied at a temperature above the average thermal cracker temperature is mixed with feed oil and a gaseous diluent, such as steam or other vapor, both supplied at a temperature below the average cracking temperature. Thereis no need to charge gaseous hydrogen to the thermal cracker. The components in the resulting mixture of feed oil, gaseous diluent and entrained solids flow concurrently through the therma riser at an average riser temperature of 1,300° to 2,500° F. (704° to 1,371° C.) for a residence time between about 0.05 and 2 seconds. Endothermic cracking occurs in the thermal cracker so that the highest temperature occurs near the inlet of the riser, with the temperature falling slightly and gradually along the length of the riser. The thermal cracking reactor is elongated and has a high length to diameter ratio in the range of 4:1 to 40:1, generally, or 6:1 to 20:1, preferably. The reactor can be disposed either vertically or horizontally. Direction of flow is not important and in a vertically disposed riser flow can be directed either upwardly or downwardly.

Most commonly, the reactor will be an elongated riser with preheated feed oil, steam diluent and hot solids flowing concurrently upwardly or downwardly through the riser at a sufficiently high velocity that the heat carrier solids are carried in entrained flow through the riser by flowing vapors. More than 98 or 99 percent of the hot solids flowing to the riser are recirculated solids. Essentially the only solids bled off from the solids circulation system are solids or ash contained in the feed oil or very fine solids resulting from attrition of the heating solids. The size of the entrained solid particles is not important as long as the solids are sufficiently small that there is little or no slippage between the inert solids and the flowing gases. Henceforth, for convenience the thermal cracking reactor will be considered to be a vertical upflow riser with steam as the diluent vapor.

The thermal reactor of the present invention is to be distinguished from a coil thermal cracking reactor which does not utilize hot solids as an internal heat carrier agency but wherein feed oil and steam diluent flow occurs through a coil disposed in a radiant, reflective furnace chamber enclosing an open flame. In the coil type reactor the flowing stream progressively becomes heated in transit through the coil so that the stream is at its lowest temperature at the coil inlet and progressively becomes heated during passage through the coil so that it is discharged from the coil at its highest temperature. Because a coil reactor is dependent for its heat requirements upon heat transfer across the wall of the coil and along the cross-section of the coil, the diameter of the coil must be considerably smaller than the diameter of the thermal riser of the present invention in order to provide a high ratio of heat transfer surface to tube cross-section. The thermal riser of the present invention can have a considerably larger diameter than the coil reactor since all the heat is added directly to the interior of the riser by means of hot inert solids. Most of the heat is carried into the interior of the riser by the hot inert solids while a smaller portion of heat is carried into the riser by diluent steam and preheated oil. Therefore, no heat transfer is required across the riser wall. Due to the endothermic nature of the reaction and because heat is not added across the reactor wall, the maximum inlet riser temperature gradually declines along the length of the reactor. This temperature gradient along the reactor is opposite to that of the coil reactor wherein a gradual temperature increase occurs along the length of the coil due to continual inward transfer of heat across the coil wall from the surrounding flame. The use of hot inert solids as a heat source is considerably more thermally efficient than an external flame because the temperature of the flame surrounding a coil cracker is generally about 2,800° F. (1,538° C.), while the temperature of the hot solids supplied to a riser is typically about 1,700° F. (927° C.).

During operation of the coil reactor, coke is continually deposited upon the walls of the coil. Because of the small diameter of the coil, e.g. about 5 inches (12.7 cm), or less, any deposited coke forms a relatively thick layer, thereby severely inhibiting further heat transfer across the coil and tending to plug the coil. Therefore, a coil cracker cannot tolerate more than about 0.5 weight percent conversion of the feed oil to coke. If coke conversion is above this level, frequent and costly decoking with steam or air is required. Therefore, the coil reactor is most efficiently used for cracking ethane, propane, butane and light oils, such as naphtha, and exhibits greatly depressed ethylene yields when the charge comprises a heavier oil, such as light gas oil or heavy gas oil. When cracking heavier oils, the coil cracker cannot operate at as high severities as indicated by methane yield, as the process of the present invention, since coke deposits tend to increase with increasing cracking severity. This coking tendency is so pronounced with residual oils that cracking of residual oils in a coil cracker to produce olefins is not considered to be a feasible operation.

The oil feed to a coil cracker does not generally require desulfurization because although the coke formed contains most of the sulfur content of the feed oil, it is not subsequently burned. In contrast, the coke deposited on the solids of the present process is subsequently continuously burned in an external burner so that the sulfur in the feed oil is continuously emitted to the atmosphere as sulfur oxide pollutant. Therefore, in the present process if prevailing air pollution standards are to be met without resorting to stack gas scrubbing, high sulfur feed oil must be desulfurized to an extent which results in a sulfur oxide emission less than about 250 to 500 ppm by volume in the burner flue gas.

It is a particular advantage of the present process that some of the hydrogen consumed during desulfurization of the feed oil is recovered as molecular hydrogen. The hydrogen that is recovered is the hydrogen that is chemically combined with the hydrocarbon molecule, as contrasted to hydrogen that is converted to hydrogen sulfide. This hydrogen can be recovered since the high temperature thermal cracking process yields an olefinic product by splitting the relatively stable hydrogen to carbon bonds to produce free hydrogen, in addition to splitting the less stable carbon to carbon bonds. The present thermal cracking process is thereby contrasted to lower temperature cracking processes wherein the product is primarily paraffinic because cracking occurs by splitting carbon-carbon bonds and stops short of splitting the more stable carbon-hydrogen bonds.

Operation of the thermal riser of the present invention is not limited by coke formation on the reactor wall as in the case of the coil reactor because heat transfer across the reactor wall is not required and because the hot solids entrained in the reactor stream provide both a surface for the deposit of coke and a vehicle for its removal. Thereby, the entrained solids continuously carry off from the reactor most of the coke as it is formed. When heat is supplied internally, rather than across the riser wall, the diameter of the riser can be very large, for example about 3 to 40 inches (76.2 to 101.6 cm). Although most of the coke formed is carried out of the riser as particulate coke both on and off of the solids, some is dissolved in the heavy oils produced in the riser.

The entrained coke-coated solids leaving the thermal riser are passed to a burner wherein the coke is burned from the surface of the solids to both remove the coke and to heat the solids and thereby supply the required heat for the thermal cracking reaction during the next pass. While complete burn off will usually take place, such is not necessary and some coke can be recycled on the solids. Continuous addition to and removal of solids from the burner moderates combustion temperature and thereby tends to reduce or prevent formation of noxious nitrogen oxides from nitrogen present in the combustion air, which can occur during high temperature combustion. Since the solids do not normally contain sufficient coke to adequately heat the solids, supplementary fuel is supplied to the burner in the form of torch oil. Hot, substantially coke-free solids are continuously removed from the burner and are recycled to the bottom of the thermal cracking riser to provide heat thereto. The thermal cracking process of the present invention requires a supply of hot solids at only a single temperature for admixture with feed oil to accomplish cracking and does not require a plurality of solid streams at different temperatures.

Use of inert solids to continuously carry coke deposits from the reactor, rather than permitting them to accumulate within the reactor and plug it, permits thermal cracking to be performed at a high severity. Thermal cracking at a high severity can be an advantageous mode of operation. Although propylene and butadiene yields reach a peak at moderate severities and then decline, the yields of other highly valuable products tend to increase with increasing severity, including ethylene (which tends to attain a relatively flat, elevated yield level at high severities), methane, aromatics and hydrogen. A thermal riser of this invention is capable of operating with higher boiling feedstocks, at higher severities as measured by methane yield or other severity criteria and with lower levels of steam dilution to achieve a given ethylene yield, as compared to a coil thermal cracker which does not employ hot solids.

In a thermal riser of this invention, the average riser temperature is between about 1,300° and 2,500° F. (704° and 1,371° C.), generally, between about 1,400° and 2,000° F. (760° and 1,093° C.), preferably, and between about 1,430° and 1,850° F. (777° and 1010° C.), most preferably. The feed oil can be preheated in advance of the riser, if desired, or feed oil preheating can be omitted. If the oil is preheated, any preheating temperature up to the temperature of oil vaporization or coking can be employed. Immediately upon leaving the riser, the product stream should be quenched to a temperature below about 1,300° F. (704° C.). Cold solids, water, steam and recycle oils are examples of suitable quench materials. A quench temperature below 1,300° F. (704° C.), such as between about 890° and 1,300° F. (477° and 704° C.), is suitable.

A dispersent gas, preferably steam, is supplied to the oil preheater or to the riser, if desired, in any amount up to about 2 pounds per pound (908 gm. per gm.) of hydrocarbon feed. The quantity of steam required tends to increase as the boiling point of the feedstock increases. A highly paraffinic feedstock generally requires less steam than a highly olefinic or alkyl aromatic feedstock. Although the use of steam favorably influences ethylene yield and selectivity, it is a very costly factor in cracker operation. As steam consumption increases, a point approaches where the cost of additional steam and the cost of its condensation is not compensated by the incremental ethylene yield or selectivity. Every incremental increase of steam employed must be more than compensated by the value of the resulting incremental increase in yield of ethylene or other products.

The pressure employed in the riser should be adequate to force the riser effluent steam through the downstream separation equipment. The pressure will be between about 3 and 100 psig (0.2 and 7 kg/cm$^2$), generally, and between about 5 and 50 psig (0.35 and 3.5 kg/cm$^2$), preferably. A pressure above about 15 psig (1.05 kg/cm$^2$) will usually be required. The riser residence time can be between about 0.05 and 2 seconds, generally, or between about 0.05 and 0.5 seconds, preferably. Higher residence times induce either undesired olefin polymerization reactions or undesired cracking of light or heavy products. The weight ratio of solids to feed oil can be between about 4:1 and 100:1, generally, and between about 10:1 and 30:1, preferably. The hot solids can be supplied to the riser at any temperature which is at least about 50° F. (27.8° C.) above the riser outlet temperature, up to a maximum temperature of about 2,500° F. (1,371° C.). The temperature of the solids supplied to the riser will be about the temperature within the coker burner. Only one stream of solids at the desired temperature is generally required for the cracking operation. Any catalytically inert material or mixture can serve as the solid heat carrier. Suitable materials include non-catalytic alumina, alundum, carborundum, coke, deactivated catalyst, etc. Neither the particle size nor the surface area of the inert solids is critical. Any size capable of passing through the riser in entrained flow with the reactant oil and steam diluent with little or no slippage can be employed. In one particular but non-limiting example, a particle size range of 5 to 150 microns with an average size of 70 microns, was supplied to the riser. During use, the particles undergo abrasion and reduction to a smaller size. The heat content in the solids entering the riser should be sufficient to supply at least 80 or 90 percent of the heat requirement of the cracker, which is approximately 350 BTU per pound of feed oil. This constitutes the entire heat supply beyond preheat of feed oil and the heat content of the diluent gas.

In the operation of the cracker riser, since methane is the ultimate hydrocarbon cracked product, an increasing methane yield is an indication of increasing severity. There are many ways that cracker severity can be changed. For example, changes can be made in temperature, residence time, feedstock, solids to oil ratio or recycle of crackable paraffins and olefins such as ethane, propane, propylene and butane. Because the solids riser can tolerate high coke yields wide variations in severity are possible. While coil cracking of propylene is usually avoided because of a tendency of this material to coke, the present cracking process can recycle $C_3$, $C_4$ and $C_4$+ olefins, if desired.

An additional important advantage associated with the use of a solids heat carrier to supply more than 80 or 90 percent of the total cracker heat requirement arises when relatively high boiling feed oils are employed. If heavy oil fractions are subjectd to excessive preheating in a coil preheater, they would tend to coke, thereby plugging and reducing the heat transfer efficiency of the preheater. In accordance with the present invention, preheating of heavy feed oils to the extent of inducing significant cracking or coking is avoided, and significant cracking or coking first occurs in the riser in the presence of the heat carrier solids. The heavy feed oils are not subjected to the most elevated process temperatures until contact with hot solids at the bottom of the riser.

In the thermal cracker, a number of secondary reactions occur which compete with the primary cracking reactions and which necessitate the very low residence times of the present invention. Olefins present in the feedstock or produced by cracking are not only more refractory to further cracking than are paraffins, but in addition they can condense to produce benzene, toluene, xylene and other aromatics. For this reason, olefinic feedstocks tend to be improved by hydrogenation. The aromatic materials produced have a variable economic value, depending upon market conditions. Higher molecular weight aromatics are also produced. An unstable aromatic gasoline boiling range fraction is formed as well as aromatic light gas oil and heavy gas oil fractions. The higher boiling feedstocks of a given molecular type composition produce the most coke and heavy oil.

The heavier liquid product fractions can be utilized as a torch oil in the burner to supplement the fuel value of the coke on the solids. Torch oil is a lower cost fuel than the gas and naptha fuels normally employed to provide the uniform radiant heat required in the furnace of a coil cracker. In the burner, the coke-laden solids are subjected to burning in the presence of air at a temperature above 1,700° F. (927° C.). The burner flue gases can be passed to an energy recovery unit, such as steam generator or a turbo-expander. The flue gases should contain less than about 250 to 500 ppm by volume of sulfur oxides in order to be environmentally acceptable. Otherwise, a stack gas scrubber will be required. Because of the elevated combustion temperatures, the concentration of carbon monoxide will be low even with little excess air. The relatively coke-free hot solids are returned to the riser.

The total product from the thermal riser can be separated into a plurality of distinct product fractions. The lightest fraction will comprise methane and hydrogen in a ratio of one mold or hydrogen to two moles of methane. Since at increase in methane yield is an indication of an increase in process severity, high severity processes provide the advantage of high hydrogen yields. The methane and hydrogen can be separated from each other in a cryogenic unit. The ethylene product fraction comprises the highest volume gaseous olefin product. Paraffinic feeds produce the highest ethylene yields, while aromatic feed components are refractory and do not tend to produce ethylene. As cracking temperatures and residence times increase, the ethylene yield reaches a flat maximum. Ethane, propane and propylene can each be separately recovered. A $C_4$ cut can be recovered. The $C_4$'s will comprise butanes, butenes and butadiene with traces of other $C_4$'s. Butadiene can be separated from the mixture for sale. A $C_5$–$C_{10}$ cut can be recovered as a source of gasoline and aromatics. Of the total 430° F. + (221° C.+) heavy oil product the heaviest portion can be used as torch oil in the process burner; can by hydrotreated and sold as fuel; or can be used to produce needle coke or binder pitch. About 12 to 15 percent of the feed oil to the thermal cracker is required as fuel in the burner to reheat the solids. This fuel can be derived primarily from process coke, with supplemental fuel, if any, coming from the heaviest liquid products of the process. A coke yield of 3 to 5 weight percent based on feed will generally be supplemented as fuel with heavy oil in a quantity of up to about 15 weight percent based on feed to provide adequate process heat.

According to the present invention, the feedstock for the thermal cracking process comprises hydrodesulfurized residual petroleum oil. Since the primarily desired gaseous cracked product is ethylene, this invention involves conversion of the lowest value hydrocarbon fraction of a petroleum oil, i.e. the residue fraction, to a material which is essentially the highest value hydrocarbon product of petroleum conversion.

In the thermal cracking operation, aromatic compounds are least likely to yield light olefins whereas paraffins are most likely to yield light olefins. Of the paraffins, the lighter paraffins, such as n-pentane, are the most stable and require the highest cracking temperatures. Therefore, a highly aromatic oil constitutes a low quality feedstock while a highly paraffinic oil constitutes a high quality feedstock. Also, olefinic oils are most refractory than paraffinic oils. Types of petroleum feed components in order of increasing refractoriness are normal paraffins, isoparaffins naphthenes, aromatics and polynuclear aromatics. From this it is apparent that oils containing residual components ordinarily comprise the poorest type of feedstock for thermal cracking because aromatics and polynuclear aromatics become increasingly prevalent as the cut point of petroleum residue increases. However in accordance with the present invention, we have discovered that by means of adequate hydrotreatment petroleum residues can be converted into thermal cracking feedstocks of a quality comparable to distillate heavy gas oils. We have further discovered that the residual oil hydrotreatment operation on the one hand and the thermal cracking operation on the other hand can operate interdependently with respect to each other so that each operation provides a necessary material for the other. On the one hand, the hydrotreatment operation produces a hydrotreated residue which is facilely cracked by admixture with a single stream of inert solids. On the other hand, the thermal cracking operation provides a significant yield of hydrogen which can be recycled to the hydrotreating operation. The hydrotreated residue does not require staged cracking by exposure to a plurality of solid streams at different temperatures to avoid excessive coking and riser plugging, as has been taught by the priorart in regard to thermal cracking of non-hydrotreated residual oils.

Petroleum residual oils contain a significant level of resins and asphaltenes, in addition to other aromatics, and a relatively low level of saturates. Resins and asphaltenes constitute highly condensed polynuclear aromatic constituents and are the most refractory molecular species in the thermal cracking feed material. Resins and asphaltenes are defined as the residue of a n-propane extraction and, of this residue, resins are insoluble in n-pentane and benzene while asphaltenes are insoluble in n-pentane. Polynuclear aromatics have a strong tendency to coke at the elevated temperatures of thermal cracking. When residual oils are hydrodesulfurized, the resin and asphaltene materials tend to become hydrogenated so that they are no longer insoluble in n-propane. In the course of this hydrogenation, the level of simple aromatics in the oil progressively increases because of conversion of polynuclear compounds to more simple n-propane-soluble aromatic types. As the depth of desulfurization increases and the quantity of unconverted resins and asphaltenes diminishes, the newly produced aromatics tend in turn to be converted to hydroaromatics, or saturates, at a faster rate than additional aromatics are being formed. Therefore, an increasing depth of desulfurization is accompanied by a peaking and subsequent progressive decline in aromatics level. In accordance with the present invention, we have found that adequate desulfurization of a residual oil to convert it into a high quality thermal cracking feedstock is accompanied by changes in the aromatic content of the oil so that the aromatic content of the oil initially increases, passes through a maximum and then declines. Such a hydrodesulfurization is a costly operation because a considerable amount of hydrogen is consumed in saturation of aromatics, i.e. in a non-sulfur-selective reaction.

We have now found that hydrotreatment of a residual oil as described upgrades the residual oil sufficienty that it can be thermally cracked at a severity which is sufficiently high to produce a high yield of gaseous hydrogen, whereby a significant recovery of the non-sulfur-selective hydrogen consumed during the hydrodesulfurization operation is realized in the thermal cracking operation. For example, we have found that a non-hydrotreated atmospheric tower bottoms residual oil when thermally cracked at about the highest practical severity in view of coke formation produced abpout 0.3 weight percent of hydrogen. In contrast, when thermally cracking a hydrotreated residual oil of this invention, coke formation was sufficiently low that the oil could be cracked at a much higher severity, resulting in a hydrogen yield of 0.9 weight percent. Since a one weight percent yield of hydrogen is equivalent to a recovery of about 500 standard cubic feet per barrel (8.9 SCM/100L) of the hydrogen consumed during a prior hydrotreatment, the incremental increase in hydrogen yield during thermal cracking of a hydrotreated residual oil constitutes an enhanced hydrogen recovery equivalent to 300 standard cubic feet per barrel (5.3 SCM/100L).

It is noted that a catalytic cracking process, such as a zeolitic fluid catalytic cracking process for the production of gasoline, is not capable of producing a substantial hydrogen yield, even when the feed oil is similarly hydrotreated. The reason is that the temperature of such a cracking process is considerably below the temperature of the present process so that the type of cracking which occurs is the severing of carbon-carbon bonds whereby a paraffinic product is produced. A considerably higher temperature is required to sever hydrogen-carbon bonds, and it is only when cracking temperatures are sufficiently high that olefins, such as ethylene, are produced in significant quantity that a significant hydrogen yield can be realized. A high hydrogen yield accompanies a high olefin yield because olefins are produced by dehydrogenation or paraffinic compounds.

In the feed oil hydrodesulfurization operation, the hydrogen consumed in the removal of sulfur atoms is irretrievably lost as hydrogen sulfide. However, the interdependence between the hydrodesulfurization operation and the thermal cracking operation arises because the saturated componds formed during the hydrodesulfurization operation constitute high quality low refractory feed material for thermal cracking which permits the thermal cracking operation to be sufficiently severe to produce an enhanced yield of molecular hydrogen.

The high level of hydrogen recovery in accordance with the present invention is highly specific to the method of thermal cracking in the presence of entrained inert heat carrier solids, as contrasted to the use of a coil passing through a furnace without the introduction of hot solids. We have found that in the coil type of thermal cracker, the hydrogen yield decreases with increasingly high boiling feedstocks. In contrast, we have discovered that when employing a riser supplied with hot solids to accomplish thermal cracking under otherwise comparable conditions, the hydrogen yield remains constant with increasingly high boiling feedstocks. This observation is particularly critical since the hydrodesulfurizated feed oil of the present invention is a residual oil, and is therefore the feed oil that provides the greatest benefit from this discovery.

We have found that thermal cracking of a hydrodesulfurized residual oil with a given steam dilution level produces a slightly greater 1,3-butadiene yield than does thermal cracking of a hydrotreated distillate heavy gas oil with the same steam dilution level. This is an advantage since 1,3-butadiene is a product whose yield peaks at moderate thermal cracking severities and hydrotreated residual oils are generally more successfully cracked at moderate severities than at high severities, due to the limited ethylene yield obtainable from highly aromatic oils.

The importance of hydrogen recovery from a hydrodesulfurized residual oil is apparent from the following table which shows the amounts of hydrogen consumed and the hydrogen content of the oil when desulfurizing a Kuwait residual oil containing 4 weight percent sulfur to progressively lower sulfur levels. The table shows that a disproportionately great hydrogen consumption and oil hydrogen acquisition occurs as the depth of desulfurization increases.

| | Feed Oil | Hydrodesulfurized Oil | | |
|---|---|---|---|---|
| Sulfur Content of Oil, Wt. % | 4 | 1 | 0.3 | 0.1 |
| Hydrogen Content of Oil, Wt. % | 10.97 | 11.95 | 12.25-12.30 | 12.50 |
| Chemical Hydrogen Consumption SCF/B (SCM/100L) | — | 580 (10.44) | 800 (14.4) | 900 (16.2) |
| Total Hydorgen Consumption, Including Solution Losses SCF/B (SCM/100L) | — | 650 (11.7) | 925 (16.65) | 1050 (18.9) |

The above table shows that desulfurization of a residual oil consumes considerable amounts of hydrogen, and the amount of hydrogen required per increment of sulfur removed increases disproportionately as the depth of desulfurization increases, indicating an increase in non-sulfur-removing hydrogenation reactions. Therefore, during initial desulfurization the hydrogen consumed is most selectively utilized for sulfur removal and as the extent of desulfurization increases the hydrogen consumed becomes less selective for sulfur removal. This non-selective hydrogen is the hydrogen which is recoverable in the thermal cracking process of the present invention.

The above table shows that the oil acquired about 1 weight percent hydrogen when losing about 3 weight percent sulfur to become desulfurized from a 4 to a 1 weight percent sulfur level, in relatively sulfur-selective reactions, and then acquired about an additional 0.5 weight percent hydrogen to lose only 0.9 weight percent sulfur to become desulfurized from a 1 to a 0.1 weight percent sulfur level in less sulfur-selective reactions. The relatively less sulfur-selective reactions involve significant conversion of aromatics to saturates and occur after the oil has already acquired at least about 1 weight percent hydrogen. The low-sulfur-selective reactions are in general a characteristic of residual oil hydrodesulfurization since the hydrogen being consumed converts aromatics derived from resins and asphaltenes, which materials are not present in distillate oils Each 1 percent of hydrogen acquired by the oil represents a hydrogen consumption of at leastabout 5000 standard cubic feet per barrel (8.9 SCM/100L), and represents the same potential hydrogen recovery during subsequent thermal cracking.

FIG. 1 illustrates the nature of the non-sulfur-selective hydrogen consuming reactions which occur as the level of desulfurization of the residual oil increases. FIG. 1 shows that at low levels of desulfurization, resin and asphaltene molecules, which are polynuclear condensed ring structures, accept hydrogen and are converted to aromatics. A relatively low level of non-sulfur selective hydrogen is required to accomplish this conversion. However, after at least 75 percent desulfurization (1 percent sulfur remaining in the oil), very little further conversion of resins and asphaltenes occurs. Instead, the aromatics become converted to saturates, such as naphthenes, faster than they are formed. Although complete saturation of aromatics requires very severe conditions, partial saturation of aromatics requires relatively mild hydrotreating conditions. This non-sulfur-selective hydrogen consuming reaction results in an increased level of hydrogen consumption per unit of sulfur removal. Although the saturates formed are less refractory and constitute a superior cracker feedstock, because of the high cost of hydrogen the severity of the desulfurization process will be determined by the required product sulfur content necessary to produce a burner flue gas in the process scheme described below having a sulfur oxide concentation below about 250 to 500 parts per million by volume which is presently the maximum acceptable flue gas sulfur oxide concentration if use of a stack gas scrubber is to be avoided. The amount of sulfur oxides in the burner flue gas is directly dependent upon the sulfur content of the feedstock to the thermal cracker since 65 to 70 percent of the sulfur in the feedstock is ultimately concentrated in the coke and heavy oil product of the process, both of which are used as fuel in the burner. Therefore, the recovery of hydrogen consumed during thermal cracking becomes particularly critical where a high percentage of desulfurization of the residual oil feedstock is required to meet air pollution standards, indicating the occurrence of the highly non-sulfur-selective hydrogen consuming reactions.

If the thermal cracker is operated under a relatively low severity, the recovery of hydrogen from the hydrodesulfurized oil will be relatively low, thereby diminishing the hydrogen recovery advantage of the present invention.

However, by operating the thermal riser at at least a moderate severity, a significant portion of the hydrogen consumed during the hydrodesulfurization operation can be recovered. Advantageously, the thermal cracker of this invention is operated at a sufficient severity that the amount of hydrogen recovered in the thermal cracker is equivalent to more than half of the hydrogen chemically combined with the hydrocarbon constituents of the feedstock during the hydrodesulfurization operation. Recovery of more than half of the hydrogen consumed by the residual oil during the hydrodesulfurization operation is particularly significant when the desulfurization operation proceeded to a depth that the aromatics level in the oil (other than resins and asphaltenes) had reached and started to decline from its peak level via chemical combination of aromatics with hydrogen, because this reaction is irrelevant to either sulfur removal or to conversion of resins and asphaltenes, which are coke formers. As shown by reference to both the above table and FIG. 1, a decline in aromatics level occurs after the oil has acquired at least 1 percent of its weight in hydrogen and, since at least half of this hydrogen is recoverable, upon thermal cracking the hydrogen yield from the oil will be at least 0.5 weight percent. The type of hydrodesulfurization reaction profile described is specific to residual oils and generally only residual oils experience during hydrodesulfurization an increase in hydrogen content equal to more than 1 weight percent of the oil. When the residual oil of the above table, which had experienced during hydrodesulfurization a hydrogen increase of about 1.5 weight percent and had consumed 900 SCF/B (16 SCM/100L) of hydrogen, was subsequently thermally cracked in accordance with this invention, a hydrogen yield of 500 SCF/B (8.9 SCM/100L) was obtained. The oil was sufficiently hydrotreated so that this hydrogen yield was accompanied by high yields of propylene and 1,3-butadiene. Since the test in the above table involving hydrogen consumptions of 580 and 900 SCF/B (10.4 and 16 SCM/100L) accomplished 75 percent and more than 95 percent desulfurization, respectively, the hydrodesulfurization of a cracker feedstock can advantageously consume an amount of hydrogen in excess of 580 SCF/B (10.4 SCM/100L) but should not consume an amount of hydrogen in excess of 1,000 or 1,200 SCF/B (17.8 or 21.4 SCM/100L) because such a high hydrogen consumption would indicate the surpassing of nearly complete desulfurization and the advent of hydrocrackin reactions which would constitute an extreme waste of hydrogen in view of the subsequent thermal cracking step which does not require hydrogen for cracking and in view of the less complete recovery of hydrogen during thermal cracking.

The residual oil hydrodesulfurization operation can be performed in one, two or three stages, with or without one or more interstage flash removal steps for the removal of contaminating gases, such as hydrogen sulfide, ammonia and light hydrocarbons. Typical hydrodesulfurization catalysts include supported Group VI-B and Group VIII metals on a non-cracking support. Active metal combinations can include cobalt-molybdenum, nickel-tungsten and nickel-molybdenum. Nickel-cobalt-molybdenum is a preferred combination. A Group IV-B metal such as titanium can also be employed. Alumina is the preferred supporting material but other non-cracking supports can be used such as silica alumina and silica magnesia.

The hydrodesulfurization temperature can range between 650° and 900° F. (343° and 482° C.), generally, and between 680° and 800° F. (360° and 427' C.), preferably. The temperature will increase to compensate for catalyst aging. The temperature should be low enough to avoid any significant hydrocracking. The hydrogen partial pressure can be between 250 and 5,000 pounds per square inch (17.5 and 350 kg/cm$^2$), generally, 500 to 3,000 pounds per square inch (35 to 210 kg/cm$^2$), preferably, and 1,000 to 2,500 pounds per square inch (70 to 175 kg/cm$^2$), most preferably. The gas circulation rate can be between about 2,000 and 20,000 standard cubic feet per barrel (35.6 and 356 SCM/100L), generally, or preferably about 3,000 to 10,000 standard cubic feet (54.3 to 178 SCM/100L) of a gas containing 85 percent or more of hydrogen. The mol ratio of hydrogen to oil can be between about 8:1 and 80:1. The liquid hourly space velocity can be between about 0.2 and 10, generally, and between about 0.3 and 1 or 1.25, preferably.

A suitable residual oil hydrodesulfurization process is described in U.S. Pat. No. 3,905,893, which is hereby incoporated by reference. The process of that patent was utilized to perform the hydrodesulfurization tests of the above table.

While free hydrogen is charged to the hydrodesulfurization process, it is not necessry to charge free hydrogen to the thermal cracking process. To avoid waste of hydrogen, the hydrodesulfurization process should be essentially free of hydrocracking of feed components boiling above the gasoline range to material boiling within or below the gasoline range. In the hydrodesulfurization process not more than 20 percent, generally, of feed components boiling above the gasoline range or, preferably, not more than 2 to 5 percent of feed components to the hydrodesulfurization process boiling above the gasoline range should be converted to gasoline range or lighter materials. the hydrodesulfurization process should be so free of hydrocracking to lighter materials that when charging atmospheric tower bottoms, i.e 650° F.+ (343° C/.+) residue, not more than 25 or 35 percent of this feed will be converted to material boiling below 650° F. (343° C.) and preferably not more than 20 percent of this feed will be converted to material boiling below 650° F. (343° C.). The hydrodesulfurization process should be capable of hydrodesulfurization to produce an effluent wherein 70 or 80 percent by volume of the feed is recovered having a boiling point at least as high as the initial boiling point of the hydrodesulfurization feed oil. The hydrodesulfurization catalyst advantageously can be so free of cracking activity that after brief conditioning of the catalyst, the amount of hydrocracking experienced with the catalyst can be about the same as that experienced with inert solid particles.

The hydrodesulfurization effluent may be flashed, if desired, prior to the thermal cracking operation. The flash step will remove contaminating materials such as hydrogen sulfide, ammonia and methane. The flash liquid may be preheated prior to thermal cracking, if desired. The use of a liquid preheater will not result in significant coke deposition on preheater coils because of the significant removal of coke-forming resins and asphaltenes during the desulfurization step. The use of a liquid preheater can provide an opportunity to use any available process waste heat in the form of steam and could reduce the circulation of solids, if such is desired. The preheater can obtain heat from the solids heater flue gas or can be directly fired.

In a further embodiment of the present invention, a distillate heavy gas oil can be thermally cracked cooperatively with a hydrodesulfurized residual oil, either in blend with the residual oil, or as an independent stream in a separate riser. If the separate riser embodiment is employed, the process utilizes at least two thermal cracking risers in parallel, both operating within the condition ranges given above. Certain process economies result from the use of separate risers. In separate risers, each feedstock can be cracked at a different severity, as indicated by methane yield, or with a different steam dilution level. For example, if the petroleum distillate feedstock has a higher paraffinic content, or if the residual oil experienced inadequate conversion of resins and asphaltenes the residual oil would require a higher steam dilution level. An unblended hydrodesulfurized residual oil stream having a relatively high sulfur content is passed to one parallel riser and an unblended distillates heavy gas oil stream having a relatively lower sulfur content is charged to another parallel riser. In the present embodiment, the residual oil stream is inadequately desulfurized, whereby the coke deposits on the inert solids on combustion in the process burner will yield a flue gas having too high a concentration of sulfur oxides to meet environmental requirements. The distillate heavy gas oil, which may also be hydrodesulfurized, has a sulfur level sufficiently low so that the coke deposits formed from it upon combustion in a process burner will produce a flue gas whose sulfur oxides concentration is less than the maximum set by air pollution standards. The present embodiment utilizes blended or independent streams of hydrodesulfurized residual oil and distillate gas oil in proportions such that upon combustion of the combined coke-laden entrained solids, with or without torch oil, the sulfur oxide concentration of the flue gas is sufficiently low to meet environmental flue gas sulfur oxide requirements.

A significant advantage of the present embodiment is that a compounded process hydrogen economy can be achieved by employing a relatively lower sulfur distillate heavy gas oil to compensate for the insufficienty of desulfurization of the residual oil. The insufficiency of desulfurization of the residual oil represents a first savings in hydrogen. Furthermore, we have found that an unexpectedly high hydrogen yield is achieved from the distillate heavy gas oil itself. We have discovered that an unexpectedly high level of hydrogen recovery is achieved when heavy distillate oils are thermally cracked in the presence of entrained inert heat carrier solids as contrasted to the thermal cracking of heavy distillate oils in a coil surrounded by a flame and without the introduction of hot solids. We have found that in a coil type of thermal cracker, without the use of entrained heat carrier solids, the hydrogen yield decreases as the boiling point of the feed oil increases. We have further found that when employing a riser supplied with hot solids to accomplish thermal cracking under otherwise comparable conditions, the hydrogen yield from the cracking operation remains uniformly high as the boiling point of the feed oil increases. This discovery of high hydrogen yield in thermal cracking of heavy oils is particularly critical in accordance with the present invention, since the two feedstocks of the present embodiment, residual oils and heavy gas oils, are the highest boiling feed fractions of a petroleum oil.

Figure 2:
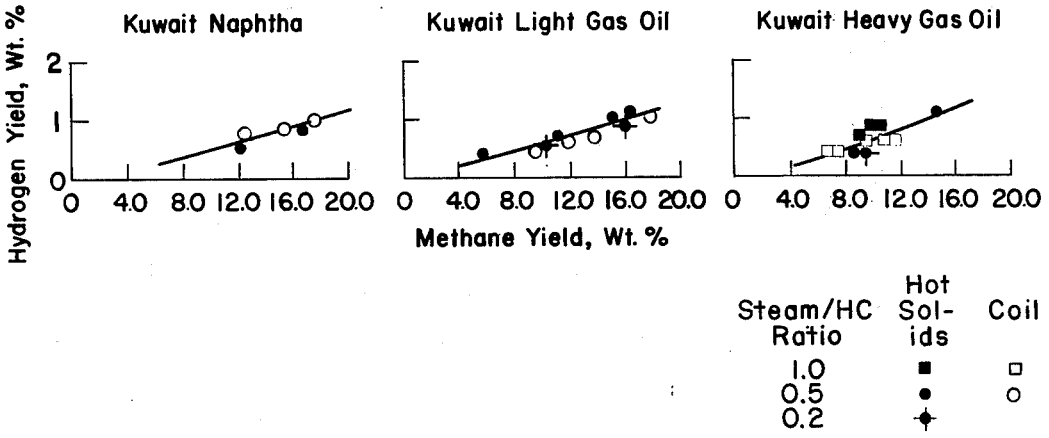

FIG. 2 shows the results of thermalcracking tests employing three feedstocks of increasing boiling point, including naphtha, hydrotreated light gas oil and hydrotreated heavy gas oil. FIG. 2 shows that as the boiling point of the feedstocks increase, the hydrogen yield decreases when an externally heated coil cracker is utilized. FIG. 2 further shows that when a hot solids cracker is utilized, a constant hydrogen yield is maintained as the boiling point of the feedstocks increases. These data show a distinct advantage in hydrogen yield by utilizing a hot solids thermal cracker for the thermal cracking of increasingly high boiling point feedstocks.

In summation, the present embodiment is capable of achieving a compound hydrogen economy. The first economy is due to the diminished hydrogen consumption during the residual oil hydrodesulfurization step permitted by dilution of the inadequately hydrodesulfurized residual oil feedstock with a relatively lower-sulfur distillate heavy gas oil. The second savings is due to the surprisingly high yield of hydrogen that is achieved when a 650° F.+ (343° C.+)distillate heavy gas oil is cracked in a thermal riser employing hot inert heat carrier solids. Thereby, the use of distillate heavy gas oil not only reduces the amount of hydrogen consumed in the residual oil desulfurization step due to a dilution effect, but also itself produces hydrogen during the thermal cracking step in a greater quantity than would be expected. The hydrogen produced by thermal cracking of both the residual oil and the distillate heavy gas oil can be recycled to the feedstock hydrodesulfurization operations. If desired, these two thermal cracker feed oils can be hydrodesulfurized as a blended or straight run stream, and then separated by distillation following the hydrodesulfurization step. In this case, the boiling ranges of the two feed streams will not overlap. However, the boiling ranges of the residual oil feedstock and the distillate heavy gas oil feedstock can overlap, if desired. Also, separate hydrodesulfurization operations for these two streams can be employed.

Figure 3A:
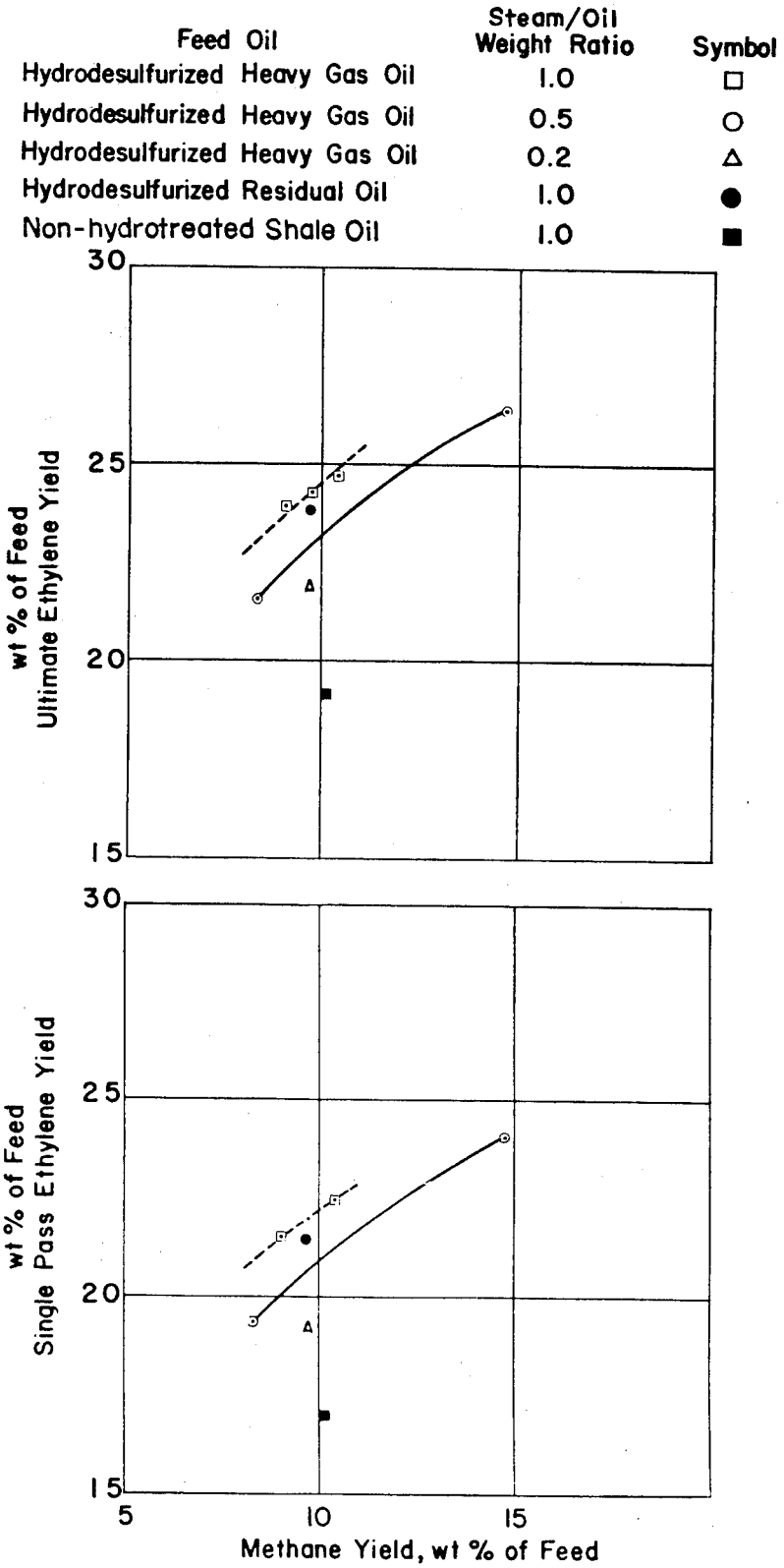
Figure 3B:
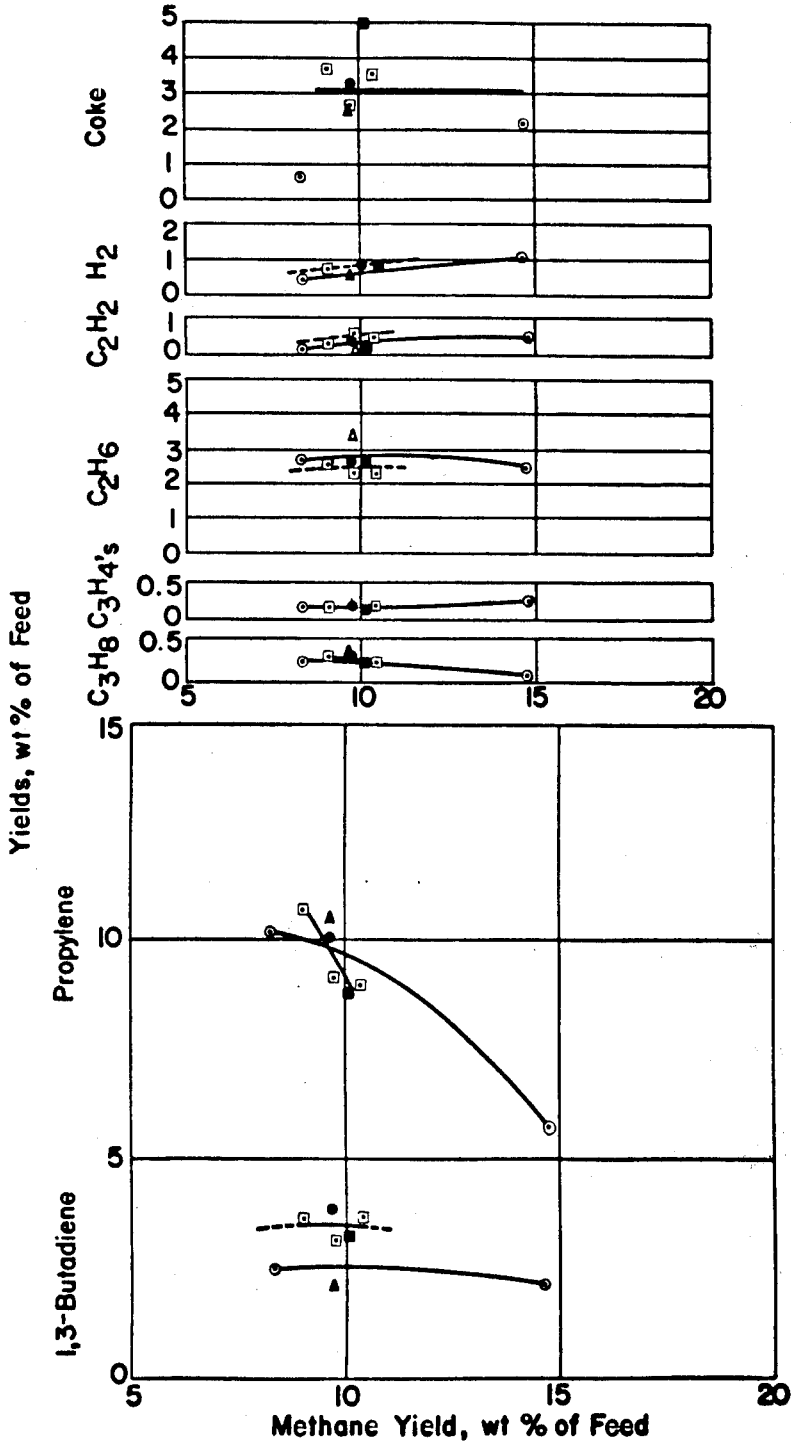
Figure 3C:
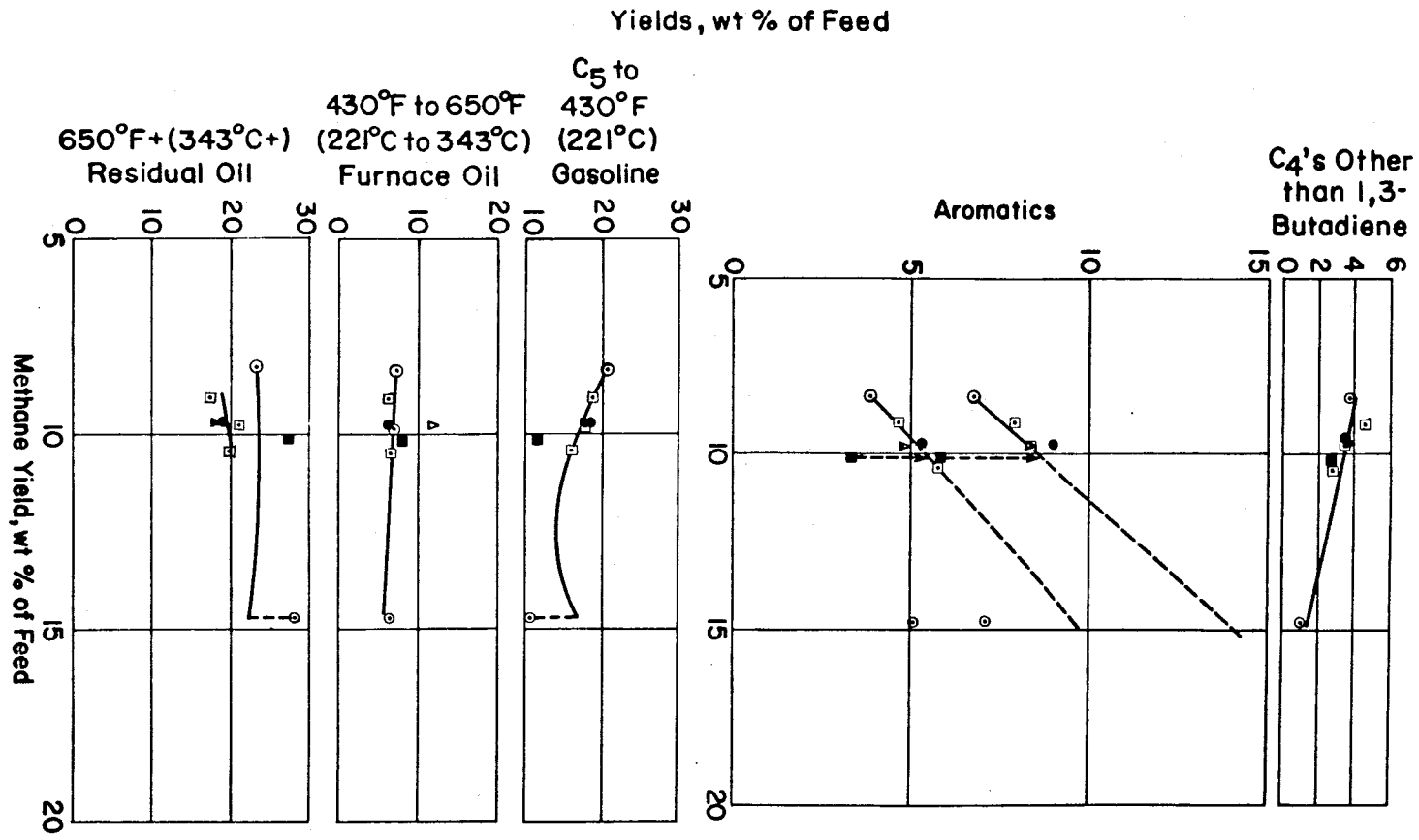

FIGS. 3A, 3B and 3C show the yields of the various products obtained by thermal cracking in the presence of entrained hot, inert solids of hydrodesulfurized petroleum residual oil and non-hydrotreated shale oil at the indicated ratios of steam to feed oil. Increasing ratios of steam to oil favorably affect ethylene and other yields. Cracking severities are expressed in terms of methane yield based on feed oil. Cracked products represented in the table include ultimate ethylene yield (ethylene plus 0.8 times the sum of ethane and actylene), single pass ethylene yield, coke, hydrogen, $C_2H_2$, $C_2H_6$, $C_3H_4$'s, $C_3H_8$, propylene, 1,3-butadiene $C_4$'s other than 1,3-butadiene, aromatics (BTX), gasoline, furnace oil and residual oil.

FIGS. 3A, 3B and 3C show that yields of all products obtained from hydrodesulfurized residual oil are nearly the same as are obtained from hydrodesulfurized heavy gas oil at similar severities, indicating that for the purposes of the present thermal cracking process hydrodesulfurization of a petroleum residual oil upgrades its quality to that of a distillate oil even though there is not complete removal of the resins or asphaltenes from the residual oil.

Figure 4:
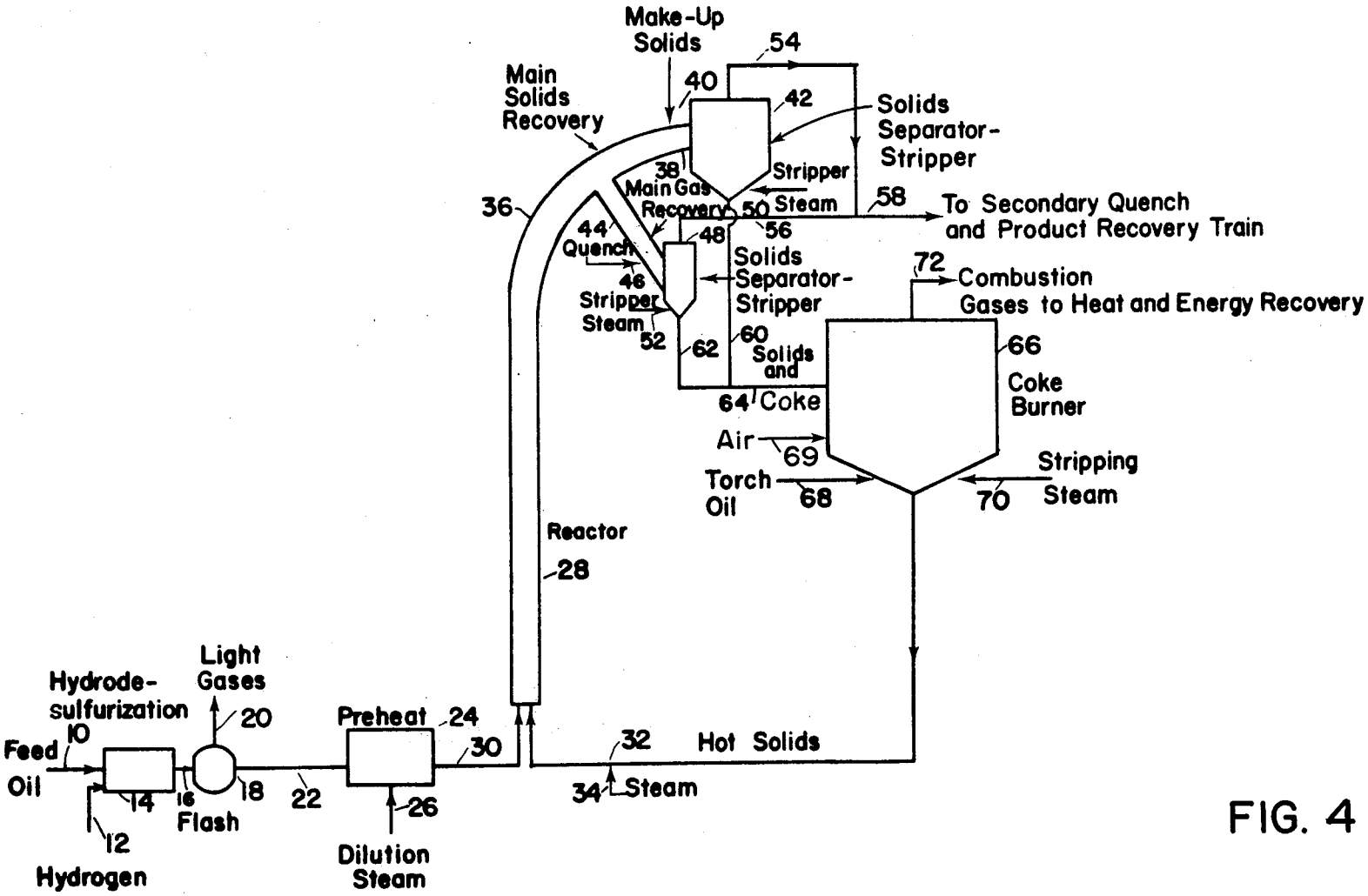

The process of this invention is illustrated in FIG. 4. As shown in FIG. 4, residual oil with or without blended distillate heavy gas oil entering through line 12 pass through hydrodesulfurized zone 14. Hydrodesulfurization effluent passes through line 16 and enters flash chamber 18 from which hydrogen and contaminating gases including hydrogen sulfide, and ammonia are removed overhead through line 20, while flash liquid is removed through line 22. The flash liquid passes through preheater 24, is admixed with dilution steam entering through line 26 and then flows to the bottom of thermal cracking reactor 28 through line 30.

A stream of hot regenerated solids is charged through line 32 and admixed with steam or other fluidizing gas entering through line 34 prior to entering the bottom of riser 28. The oil, steam and hot solids pass in entrained flow upwardly through riser 28 and are discharged through a curved segment 36 at the top of the riser to induce centrifugal separation of solids from the effluent stream. A stream containing most of the solids passes through riser discharge segment 38 and can be mixed, if desired, with make-up solids entering through line 40 before or after entering solids separator-stripper 42. Another stream containing most of the cracked product is discharged axially through conduit 44 and can be cooled by means of a quench stream entering through line 46 in advance of solids separator-stripper 48.

Stripper steam is charged to solids separators 42 and 48 through lines 50 and 52, respectively. Product streams are removed from solids separators 42 and 48 through lines 54 and 56, respectively, and then combined in line 58 for passage to a secondary quench and product recovery train, not shown. Coke-laden solids are removed from solids separators 42 and 48 through lines 60 and 62, respectively, and combined in line 64 for passage to coke burner 66. If required, torch oil can be added to burner 66 through line 68 while stripping steam may be added through line 70 to strip combustion gases from the heated solids. Air is charged to the burner through line 69. Combustion gases are removed from the burner through line 72 for passage to heat and energy recovery systems, not shown, while regenerated hot solids which are relatively free of coke are removed from the burner through line 32 for recycle to riser 28.

Figure 5:
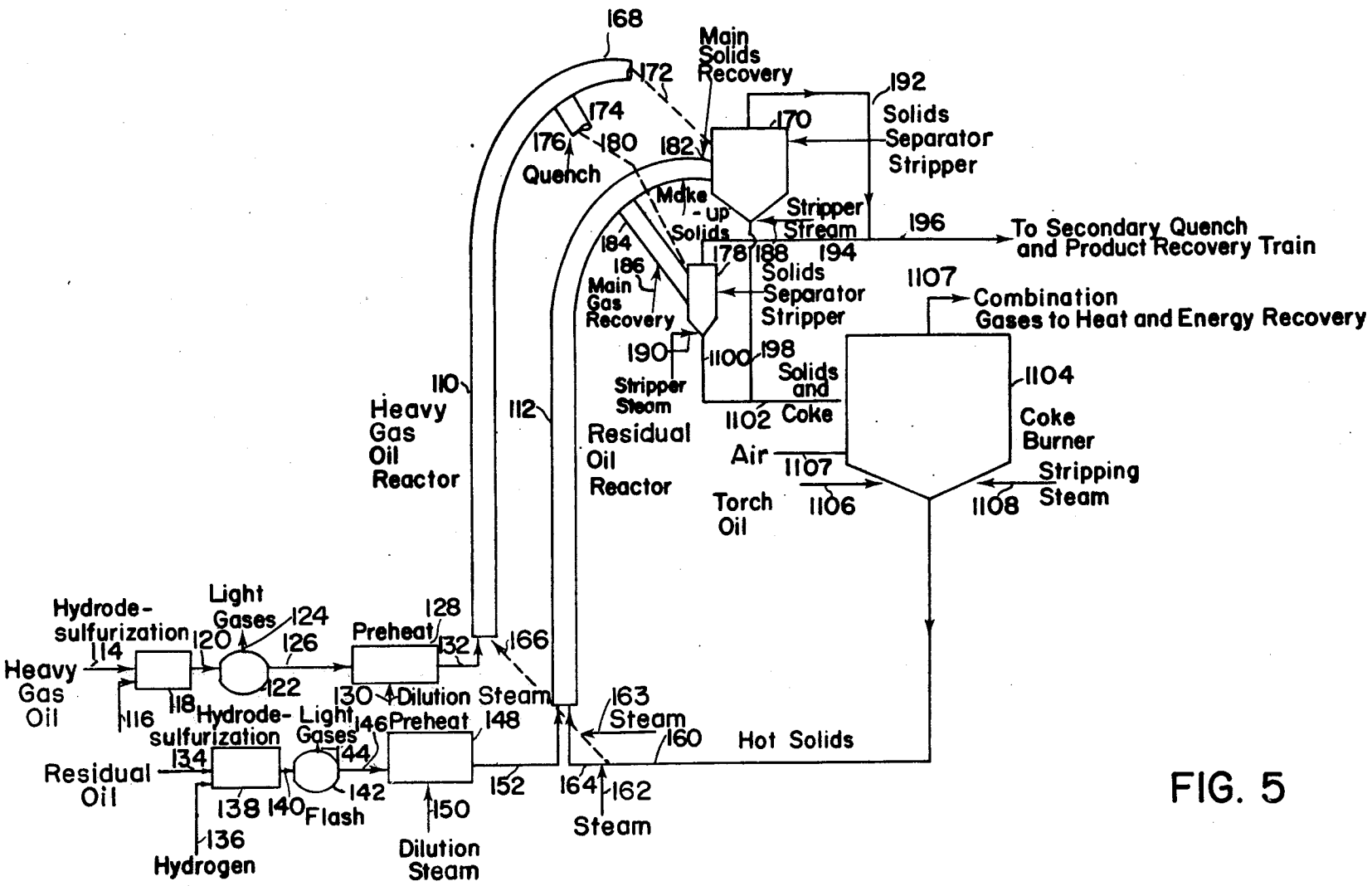

FIG. 5 illustrates a parallel riser cracker operation of this invention.

FIG. 5 shows a distillate heavy gas oil cracker riser 110 and a hydrodesulfurized residual oil cracker riser 112. Heavy gas oil entering through line 114 and hydrogen entering through line 116 pass to hydrodesulfurization zone 118 from which a hydrodesulfurized effluent is removed through line 120 for passage to flash chamber 122. Light gases comprising hydrogen sulfide, ammonia and methane are removed from flash chamber 122 through line 124. Flash liquid passes through line 126 to preheat zone 128 wherein it is admixed with dilution steam entering through line 130 prior to passage through line 132 to the bottom of thermal riser 110.

A residual oil stream entering through line 134 and hydrogen entering through line 136 enter hydrodesulfurization zone 138 and hydrodesulfurized effluent passing through line 140 enters flash chamber 142. Light gases comprising hydrogen sulfide, ammonia and methane are removed from flash chamber 142 through line 144. Flash liquid in line 146 enters preheater 148 wherein it is admixed with dilution steam entering through line 150 prior to passage through line 152 to the bottom of heavy oil cracking riser 112.

One portion of the hot regenerated solids in line 160 together with steam entering through line 162 enters the bottom of heavy oil cracker 112 through line 164 and another portion enters the bottom of light oil cracker 110 through line 166 together with steam entering through line 163. The heavy gas oil cracker has a main solids recovery zone 168 which leads to solids separator-stripper 170, as indicated at 172. The heavy gas oil reactor also has an axial main gas recovery conduit 174 which is provided with a quench fluid entering through line 176 and which discharges into solids separator-stripper 178, as indicated at 180. The hydrodesulfurized residual oil riser 112 has a main solids recovery segment 182 which also leads into solids separator-stripper 170 and has a main gas recovery conduit 184 which is provided with a quench fluid entering through line 186 and which discharges into solids separator-stripper 178. Solids separator-stripper 170 is provided with stripping steam entering through line 188 while separator-stripper 178 is provided with stripping steam entering through line 190. The cracked products from solids separator 170 are removed through line 192 while the cracked products from solids separator 178 are removed through line 194. Cracked product streams 192 and 194 are blended in line 196 and passed to a secondary quench and product recovery train, not shown. Coke-laden solids from separator 170 in line 198 and from separator 178 in line 1100 are blended in line 1102 and passed to coke burner 1104. Torch oil is passed to burner 1104, if required, through line 1106, air is charged through 1107 and stripping steam is charged through line 1108. Combustion gases are removed from the coke burner through line 1106 and passed to a heat and energy recovery system, not shown. Hot substantially coke-free regenerated solids are removed from the burner through line 160 for passage to the bottom of the thermal risers.

Use of separate risers permits the feed oils to be cracked under different conditions and different severities For example, depending upon the extent to which it was desulfurized, the residual oil may require a higher steam to oil ratio than the heavy gas oil.

We claim:

1. A process comprising passing a petroleum residual oil through a catalytic hydrodesulfurization zone in the presence of hydrogen at a temperature between 650° and 900° F. hydrogen being chemically combined with said oil during said hydrodesulfurization step, and then passing hydrodesulfurized residual oil through a thermal cracking zone together with entrained insert hot solids as the heat source and a diluent gas at a temperature between about 1,300° and 2,500° F. for a residence time between about 0.05 to 2 seconds to produce a cracked product containing ethylene and molecular hydrogen.

2. The process of claim 1 wherein said diluent gas is steam.

3. The process of claim 1 wheren the hydrogen is combined with the oil in the hydrodesulfurization step in an amount equal to at least 1 weight percent of the oil.

4. The process of claim 1 wherein the amount of hydrogen combined with the oil in the hydrodesulfurization step is between about 580 and 1,200 SCF/B.

5. The process of claim 1 wherein the hydrodesulfurization catalyst comprises Group VI-B and Group VIII metals on a non-cracking support.

6. The process of claim 1 wherein the hydrodesulfurization catalyst comprises Group VI-B and Group VIII metals together with Group IV-B metal on a non-cracking support.

7. The process of claim 1 wherein said molecular hydrogen comprises more than half of said chemically combined hydrogen.

8. The process of claim 1 wherein the hydrodesulfurization zone is maintained at a pressure between about 250 and 5,000 psi.

9. The process of claim 1 wherein at least 70 volume percent of the effluent oil from the hydrodesulfurization zone boils above the initial boiling point of the residual oil feed to the hydrodesulfurization zone.

10. The process of claim 1 wherein the effluent from the hydrodesulfurization zone is flashed to remove hydrogen-containing gases, and the hydrodesulfurized flash residue is passed to the cracking zone without free hydrogen.

11. The process of claim 1 wherein a stream of distillate petroleum heavy gas oil is blended with the residual oil in said process and is cracked in blend therewith.

12. The process of claim 1 including the additional steps of passing a stream of distillate petroleum heavy gas oil to a parallel thermal cracking zone together with entrained inert hot solids at a temperature between 1,300° and 2,500° F. for a residence time of 0.5 to 2 seconds, and passing coke-lader inert solids from both-cracking zones to a common coke burner.

13. The process of claim 12 wherein said cracking zones are operated at different severities, as measured by methane yield.

14. The process of claim 12 wherein said cracking zones are operated at different diluent gas to oil ratios.

15. The process of claim 12 wherein said heavy gas oil is hydrodesulfurized.

16. The process of claim 1 wherein hydrogen produced in the cracking zone is recycled to the hydrodesulfurization zone.

17. The process of claim 1 wherein the cracking temperature is between 1,400° and 2,000° F.

18. The process of claim 1 wherein the weight ratio of solids to oil in the cracking zone is between about 4:1 and 100:1.

19. The process of claim 1 including passing coke-laden solids from said cracking zone to a coke burning zone.

20. The process of claim 1 wherein the cracking zone comprises a vertical riser.

21. The process of claim 1 wherein the cracking zone temperature is between 1,430° and 2,500° F.

22. The process of claim 1 wherein at least 75 percent of the sulfur content of said residual oil is removed in said hydrodesulfurization zone.

* * * * *

UNITED STATES PATENT OFFICE

CERTIFICATE OF CORRECTION

Patent No. 4,061,562 Dated December 6, 1977

Inventor(s) J. D. McKinney, R. T. Sebulsky and F. E. Wynne, Jr.

It is certified that error appears in the above-identified patent and that said Letters Patent are hereby corrected as shown below:

COL. 3, line 49, "3" should read --30--

COL. 7, line 4, "most" should read --more--

COL. 14, line 15, insert --hydrodesulfurized petroleum heavy gas oil,-- before "hydrodesulfurized petroleum residual oil"

COL. 14, line 38, insert --10 and hydrogen entering through line-- before "12"

COL. 16, line 61, "0.5" should read -- 0.05 --.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*